US006077205A

United States Patent [19]

Zarillo et al.

[11] Patent Number: 6,077,205

[45] Date of Patent: Jun. 20, 2000

[54] LINEAR MOTION APPARATUS FOR STIMULATING HAMSTRING CONTRACTION TO EFFECT OPTIMUM ABDOMINAL MUSCLE CONDITIONING

[76] Inventors: William A. Zarillo, 350 Bristol St. D-12, Waterbury, Conn. 06708; John P. Diamond, Jr., 27 Williamsburg Dr., Cheshire, Conn. 06410

[21] Appl. No.: 09/076,976

[22] Filed: May 13, 1998

[51] Int. Cl.[7] ..... A63B 21/05

[52] U.S. Cl. ..... 482/121; 482/128; 482/127

[58] Field of Search ..... 482/121, 112, 482/111, 148, 128, 77, 140

[56] References Cited

U.S. PATENT DOCUMENTS

| | | | |
|---|---|---|---|
| D. 339,618 | 9/1993 | Hassell | D21/191 |
| 3,567,218 | 3/1971 | Johnson . | |
| 4,211,404 | 7/1980 | Blowsky | 482/128 |
| 4,451,080 | 5/1984 | Nix | 482/77 |
| 4,508,335 | 4/1985 | Kelley et al. . | |
| 4,509,748 | 4/1985 | Bezak . | |
| 5,009,417 | 4/1991 | Sarkozi . | |
| 5,046,726 | 9/1991 | Van Straaten | 482/128 |
| 5,106,083 | 4/1992 | Hall | 482/145 |
| 5,160,304 | 11/1992 | Van Der Hoeven | 482/128 |
| 5,403,258 | 4/1995 | Hill | 482/192 |
| 5,545,114 | 8/1996 | Gvoich | 482/140 |
| 5,669,862 | 9/1997 | Sayman | 482/127 |

*Primary Examiner*—Jerome Donnelly
*Attorney, Agent, or Firm*—Raymond A. Nuzzo

[57] ABSTRACT

A muscle strengthening apparatus comprising a first elongate member, a second elongate member, a feet securing member and a support member. The first and second elongate members have a pair of end portions. The feet securing member secures the feet of a user and is attached to an end of the first elongate member. The other end of the first elongate member has an engagement portion. The second elongate member is slidably engaged with the first elongate member. The axes of the first and second elongate members are substantially coaxial and the movement of the first and second elongate members is substantially linear. The apparatus further comprises a system for exerting a force on the first and second elongate members so as to urge the first and second elongate members in opposite directions. The support member is configured to contact the buttocks of the user and is attached to the other end of the second elongate portion. The apparatus further includes a spring disposed within the first and second elongate members wherein the spring urges the second elongate member in a direction away from the feet securing member.

17 Claims, 5 Drawing Sheets

LINEAR MOTION APPARATUS FOR STIMULATING HAMSTRING CONTRACTION TO EFFECT OPTIMUM ABDOMINAL MUSCLE CONDITIONING

COPYRIGHT NOTICE

© Copyright 1998, William Zarillo and John P. Diamond, Jr. All rights reserved.

A portion of the disclosure of this patent document contains material that is subject to copyright protection. The copyright owner has no objection to the facsimile reproduction by anyone of the patent document or the patent disclosure, as it appears in the USPTO patent file or records, but otherwise reserves all copyright rights whatsoever.

BACKGROUND OF THE INVENTION

1. Field of the Invention

The present invention relates to an apparatus for exercising and strengthening muscles of the human body.

2. Problem to be Solved

Abdominal weakness is a common problem. Physicians and personal trainers have advocated the use of the "sit-up" and/or exercise as a means of strengthening abdominal muscles. However, these conventional methods of sit-ups or crunches are ineffective and inefficient because they involve more of the hip-flexors than the abdominals.

Conventional devices for exercising and strengthening abdominal muscles are inefficient because the effort expended by the users of such devices is predominately directed to exercising the hip flexor rather than strengthening the abdominal muscles. Furthermore, many conventional exercise devices overdevelop the hip flexors, particularly the iliopsoas, which can contribute to the pouching of the lower abdominal area.

It is therefore an object of the present invention to provide a muscle strengthening apparatus for exercising and strengthening abdominal muscles which solves the aforementioned problems related to traditional sit-up exercises and addresses the deficiencies of conventional devices.

It is another object of the present invention to provide a muscle strengthening apparatus for exercising and strengthening abdominal muscles and which also simultaneously exercises and strengthens other muscles.

It is a further object of the present invention to provide a muscle strengthening apparatus for exercising and strengthening abdominal and other muscles that is easy to use.

It is yet another object of the present invention to provide a muscle strengthening apparatus for exercising and strengthening abdominal muscles that is inexpensive to manufacture.

Still other objects and advantages of the present invention will in part be obvious and will in part be apparent from the specification.

SUMMARY OF THE INVENTION

The above and other objects, which will be apparent to those skilled in the art, are achieved in the present invention which is directed to a muscle strengthening apparatus comprising a first elongate member, a second elongate member, a feet securing member and a support member. The first and second elongate members have a pair of end portions. The feet securing member secures the feet of a user and is attached to an end of the first elongate member. The second elongate member is slidably engaged with the first elongate member. The axes of the first and second elongate members are substantially coaxial and the movement of the first and second elongate members is substantially linear. The apparatus further comprises a system for exerting a force on the first and second elongate members so as to urge the first and second elongate members in opposite directions. The support member is configured to contact the buttocks of the user and is attached to the other end of the second elongate portion.

BRIEF DESCRIPTION OF THE DRAWINGS

The features of the invention are believed to be novel. The figures are for illustration purposes only and are not drawn to scale. The invention itself, however, both as to organization and method of operation, may best be understood by reference to the detailed description which follows taken in conjunction with the accompanying drawings in which.

DETAILED DESCRIPTION OF THE INVENTION

1. Definitions

Figure 1:
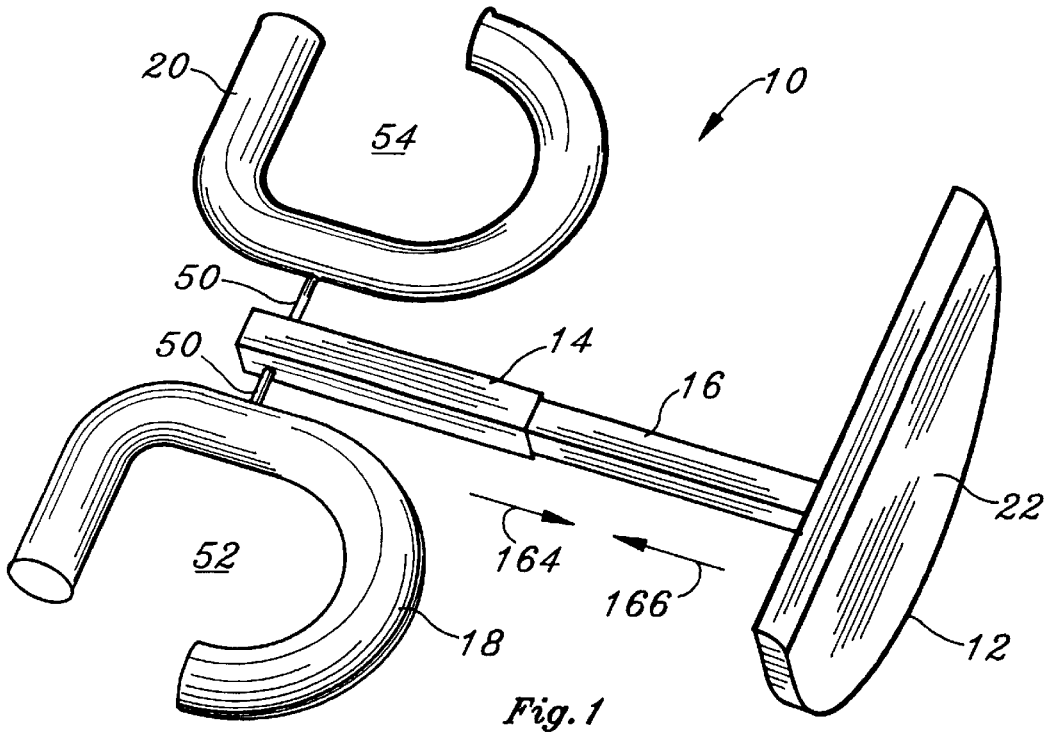
FIG. 1 is a perspective view of one embodiment of the apparatus of the present invention.

In order to facilitate understanding of the purpose and effectiveness of the present invention as well as the ensuing description, the terms shown below have been defined accordingly:

a) As used herein, the terms "abdominal muscles", "abdominals" or "rectus abdominals" refer to the muscles that connect the lower ribs and xiphoid to the pubic bone. These muscles allow flexing of the spine (curling the trunk) and cause the pelvis to posteriorly tilt.

b) As used herein, the terms "obliques" and "transverse abdominus" refer to groups of muscles that are located on the side of the abdominals. The obliques and transverse abdominus cooperate to flex the spine and pull in or retract the stomach. Unilaterally, the obliques and transverse abdominus flex the spine laterally and obliquely.

c) As used herein, the term "psoas" or "iliopsoas", refers to muscles that are located anterior to the pelvis and inserted on the lumbar spine to the femur. The "psoas" are relatively stronger than the abdominals. The psoas muscles allow flexing of the spine and femur in a forward direction.

d) As used herein, the term "hamstring" or "hamstrings" refers to the muscles in the leg that extend the femur backwards and cause the pelvis to posteriorly tilt. When the hamstrings are contracted, they contribute to the inhibition of the psoas muscles and rectus femoris.

e) As used herein, the term "Gluteus Maximum", or "Gluts" refer to the muscles that are located posterior to the pelvis and inserted on the pelvis to the femur. When the Gluts contract, they can contribute to the inhibition of the psoas muscle.

f) As used herein, the term "rectus femoris" refers to muscles that are located anteriorly to the femor. These muscles flex the femor in the forward direction.

In describing the preferred embodiments of the present invention, reference will be made herein to FIGS. 1–11 of the drawings in which like numerals refer to like features of the invention.

FIGS. 1–4 show one embodiment of the muscle strengthening apparatus of the present invention. Apparatus 10 generally comprises buttocks support member 12, elongate member 14, elongate member 16 and ankle supports 18 and 20. Support member 12 contacts the buttocks and/or posterior thighs of the user. Support member 12 has top surface 22 that is configured with a predetermnined contour that corresponds to the bone and muscular structure between the buttocks (gluteus maximus) and the upper hamstrings of the human anatomy. In a preferred embodiment, support member 12 has a substantially semi-circular shape, is substantially rigid and is fabricated from lightweight, durable materials such as plastic, rubber, fiberglass, graphite or other composite materials. Support member 12 may also have shapes other than the semi-circular. Support member 12 has mounts 24, 26 for attachment to the elongate member 16. In a preferred embodiment, mounts 24, 26 of support member 12 are rigidly attached to the elongate member 16. In an alternate embodiment, mounts 24 and 26 are pivotally mounted to the elongate member 16.

Referring to FIGS. 1–4, elongate member 14 is hollow and is sized for receiving elongate member 16. Elongate member 16 is hollow and is slidably disposed within elongate member 14. In a preferred embodiment, the axis of elongate member 14 is substantially coaxial with the axis of the elongate member 16. The motion of members 14 and 16 is substantially linear. In a preferred embodiment, elongate members 14 and 16 have a substantially square or rectangular cross-sectional shape in order to reduce torsional twisting of members 14 and 16. However, members 14 and 16 may also have other cross-sectional shapes. For example, in an alternate embodiment, members 14 and 16 each have a slightly oval cross-section. However, elongate members 14 and 16 may also have other cross-sectional shapes, e.g. substantially circular cross-section, etc. In another embodiment, elongate members 14 and 16 may have substantially I-shaped cross-sections.

Elongate members 14 and 16 are preferably made from durable, flexible materials such as plastic, flexiglass or fiberglass. However, other materials having the required durability and flexibility may also be used, e.g. metal.

Figure 4:
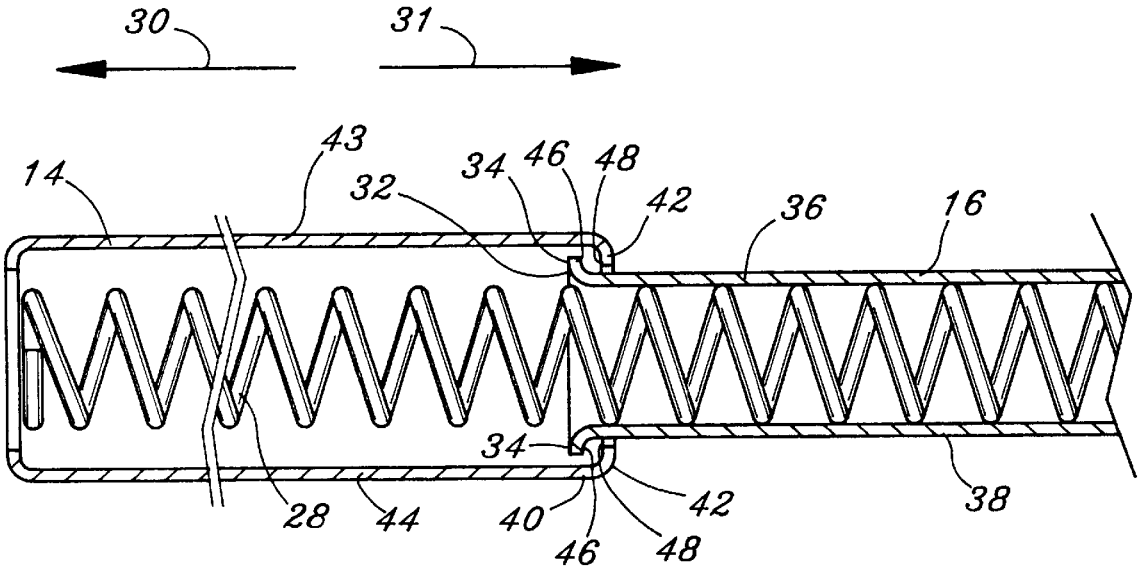
FIG. 4 is a partial, side-elevational view, in cross-section showing an elongate spring disposed within the elongate members depicted in FIGS. 1 and 2.

Referring to FIG. 4, the apparatus 10 further includes a resilient member disposed within elongate members 14 and 16. The resilient member can be configured as any one of suitable devices such a spring, coil, shock absorber, etc. As an example, FIG. 4 shows the resilient member configured as a spring 28. When the spring 28 is in its uncompressed state, it extends for the substantially the entire combined lengths of the elongate members 14 and 16. The spring 28 urges elongate members 14 and 16 in the direction indicated by arrows 30 and 31, respectively.

As shown in FIG. 4, elongate member 16 has an end portion 32. The end portion 32 includes outwardly extending flanged portion 34. Elongate member 14 has an end portion 40. The end portion 40 includes inwardly extending flanged portion 42. The flanged portion 34 has surface 46. The flanged portion 42 has surface 48. When elongate member 16 is extended the farthest in the direction indicated by 31, surface 46 contacts surface 48 to prevent member 16 from becoming dislodged from member 14. In one embodiment, pads or cushions (not shown) are attached to surfaces 46 and 48 in order to minimize vibrations and noise that may result when surface 46 contacts surface 48. The pads or cushions are preferably fabricated from materials that are suitable to minimizing noise and vibrations.

Figure 2:
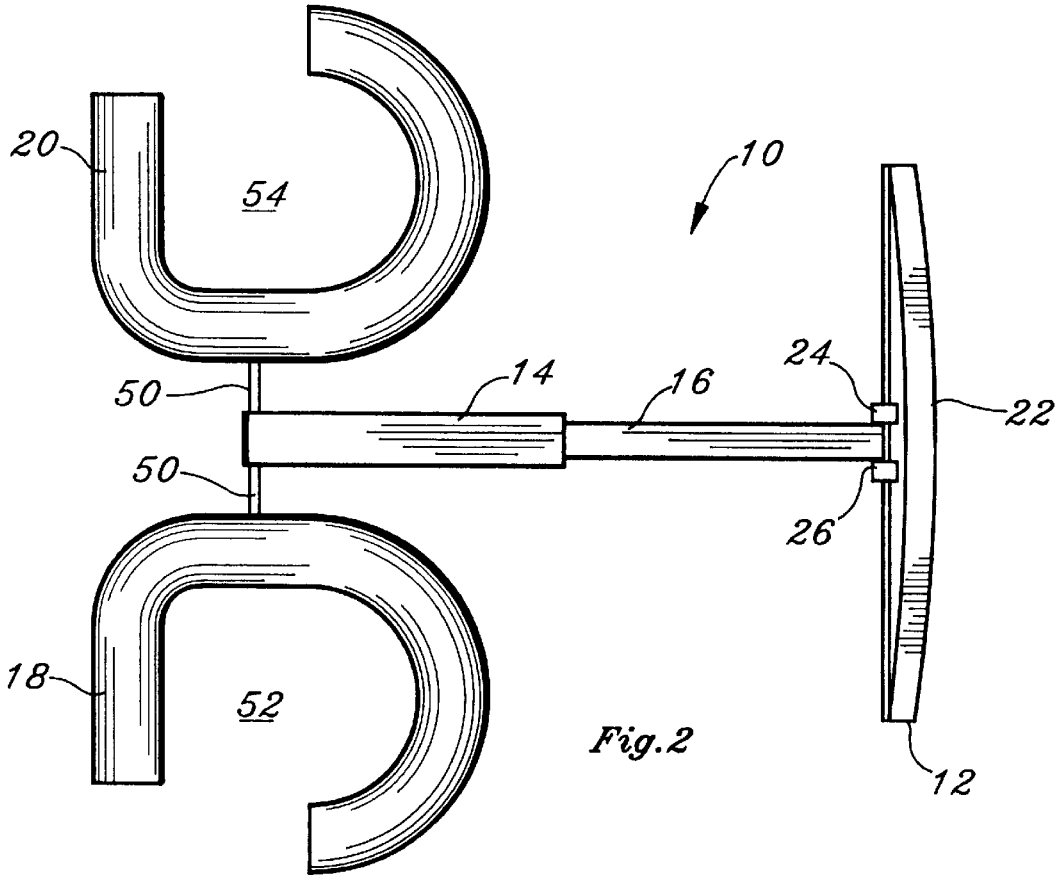
FIG. 2 is a top plan view of the apparatus of FIG. 1.
Figure 3:
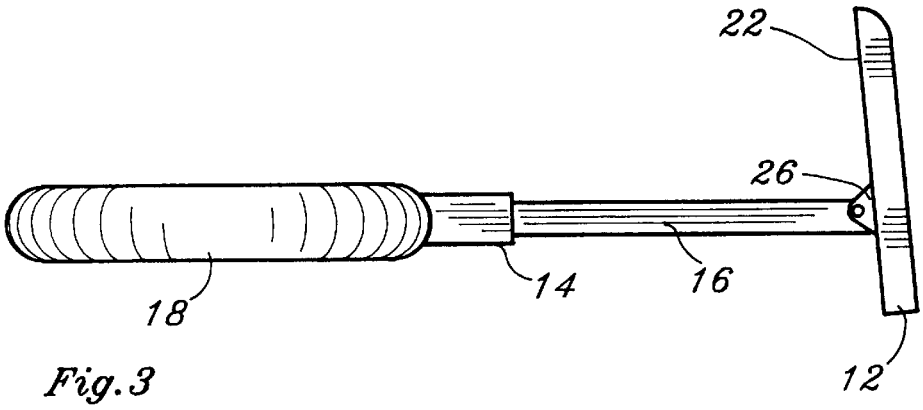
FIG. 3 is a side, elevational view of the apparatus of FIG. 1.

Referring to FIGS. 1 and 2, elongate member 14 includes a bore therethrough that is sized for receiving axle or pin 50. Ankle supports 18 and 20 are attached to axle 50. In a preferred embodiment, ankle supports 18 and 20 are rotatably attached to the axle 50. The ankle supports 18 and 20 have a body portion that defines openings 52 and 54, respectively, for receiving the feet and ankles of a user. The ankle supports 18 and 20 stabilize the feet and ankles to facilitate proper use of apparatus 10 of the present invention. This will be discussed in detail below. The ankle supports 18 and 20 are able to freely rotate or pivot to provide "self adjustment" as the user uses apparatus 10 and to facilitate storage of apparatus 10 when not in use. In a preferred embodiment, the ankle supports 18 and 20 are able to rotate 360°. The overall structure of each ankle support 18 and 20 is ergonomic so as to provide comfortable physical contact between the user's ankles and ankle supports 18 and 20. The rotational feature and ergonomic design of the ankle supports 18 and 20 substantially eliminate stress and/or strain on the user's ankles. In a preferred embodiment, the ankle supports 18 and 20 have a substantially circular cross-section. The ankle supports 18 and 20 may take on any one of a variety of geometric shapes, e.g. substantially C-shaped, substantially J-shaped, etc. In a preferred embodiment, ankle supports 18 and 20 are fabricated from durable, lightweight materials such as metal, plastic, rubber, fiberglass, graphite or other composite materials. In a preferred embodiment, axle or pin 50 is fabricated from durable materials that can withstand stress. Preferably, the axle or pin 50 is fabricated from metal, fiberglass, graphite or other composite materials.

In one embodiment, the pin or axle 50 is rigidly attached to elongate member 14 and ankle supports 18 and 20 are rotatably attached to axle 50. In another embodiment, the pin or axle 50 is slidably and rotatably disposed within the bore in the elongate member 14 and the ankle supports 18 and 20 are rigidly attached to the axle 50. In a further embodiment, the axle 50 is comprised of two separate axle portions wherein each axle is rigidly attached to the elongate member 14 and a corresponding ankle support is rotatably attached to the axle portion.

Referring to FIGS. 5–8, another embodiment 100 of the present invention is shown. Apparatus 100 generally comprises buttocks support member 102, elongate member 104, elongate member 106 and ankle supports 108 and 110. Support member 102 contacts the buttocks and/or posterior thighs of the user. Support member 102 has top surface 112 that is configured with a predetermined contour that corresponds to the bone and muscular structure between the buttocks (gluteus maximus) and the upper hamstrings of the human anatomy. In a preferred embodiment, support member 102 has a substantially semi-circular shape, is substantially rigid and is fabricated from lightweight, durable materials such as plastic, rubber, fiberglass, graphite or other composite materials. Support member 102 may also have shapes other than the semi-circular. Support member 102 has mounts 114, 116 for attachment to member 106. In a preferred embodiment, mounts 114, 116 of support member 102 are rigidly attached to one end of elongate member 106. In an alternate embodiment, mounts 114, 116 are pivotally attached to the elongate member 106.

Referring to FIGS. 5–8, elongate member 106 is hollow and is sized for receiving elongate member 104. Elongate member 104 is slidably disposed within elongate member 106. In a preferred embodiment, the axis of elongate member 104 is substantially coaxial with the axis of the elongate member 106. The motion of members 104 and 106 is substantially linear. Elongate member 104 has an end 107 (see FIG. 8) disposed within member 106. Similarly, elongate member 106 has an end 109. Each elongate member 104 and 106 has a specific cross-section to effect a specific flex mode. In a preferred embodiment, elongate members 104 and 106 have a substantially square or rectangular cross-sectional shape in order to reduce torsional twisting of members 104 and 106. However, members may also have other cross-sectional shapes. For example, in an alternate embodiment, members 104 and 106 each have a slightly oval cross2 section. However, elongate members 104 and 106 may also have other cross-sectional shapes, e.g. substantially circular cross-section, etc. In another embodiment, elongate members 104 and 106 may have substantially I-shaped cross-sections. Elongate members 104 and 106 are preferably made from durable, flexible materials such as plastic, flexiglass or fiberglass. However, other materials having the required durability and flexibility may also be used, e.g. metal.

Figure 6:
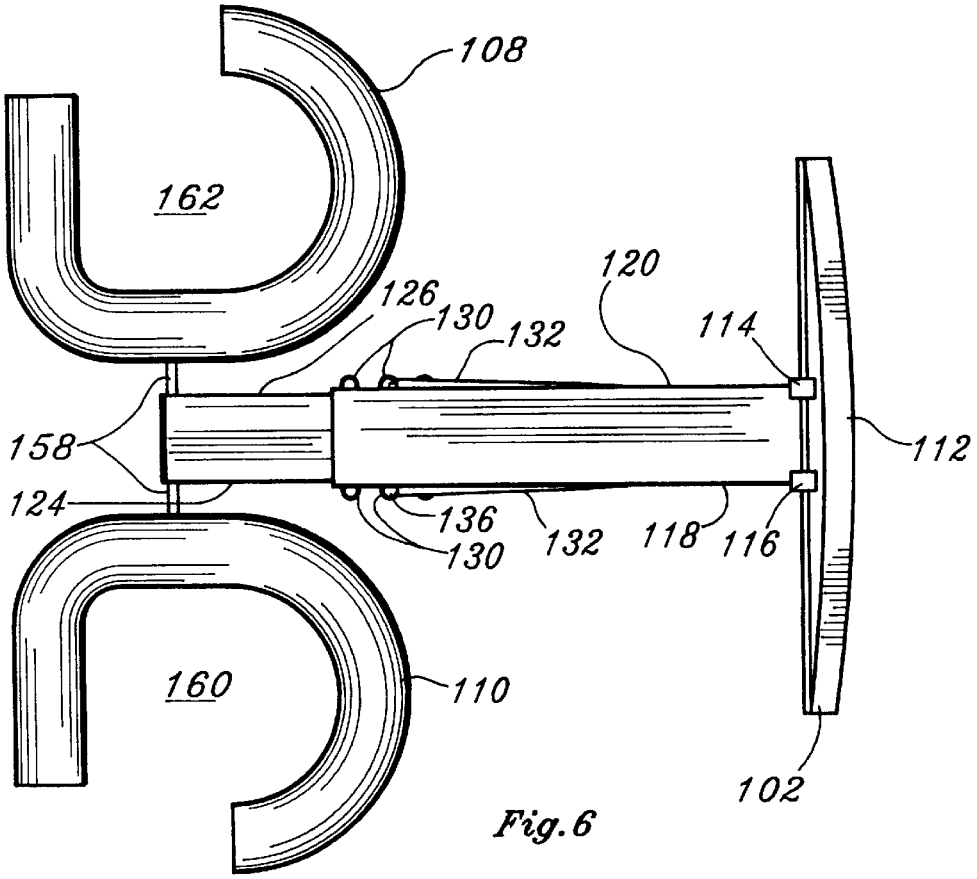
FIG. 6 is a top plan view of the apparatus of FIG. 5.
Figure 7:
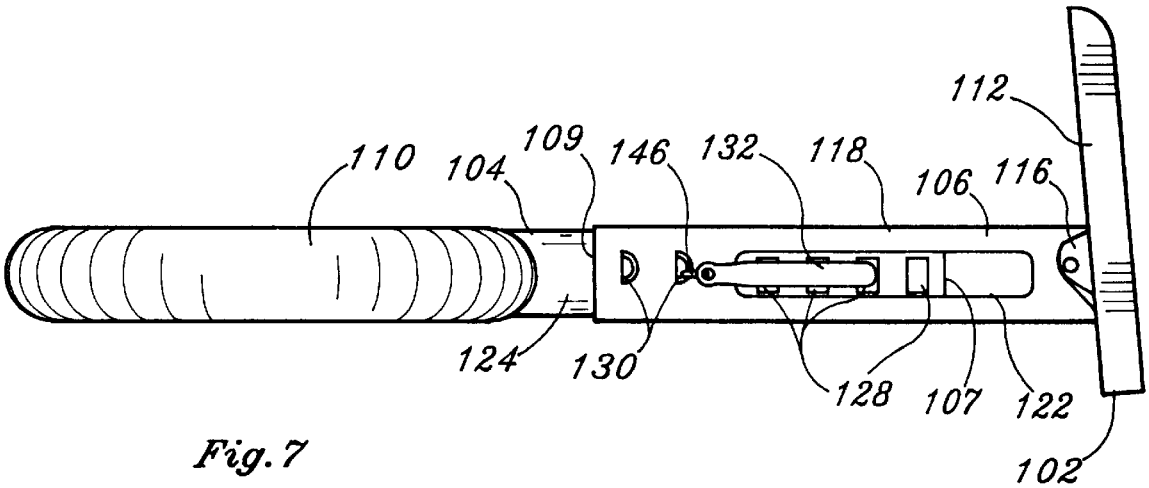
FIG. 7 is a side-elevational view of the apparatus of FIG. 5.
Figure 8:
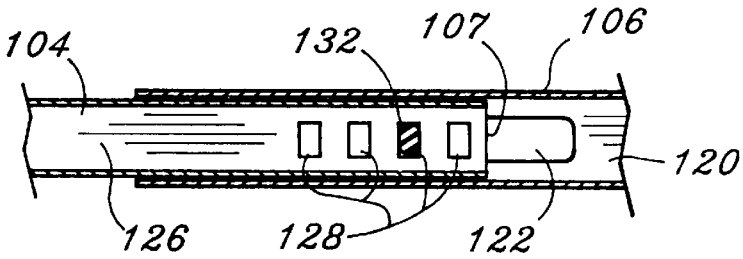
FIG. 8 is a partial, side-elevational view, in cross-section, illustrating the sliding engagement of elongate members depicted in FIGS. 5–7.

Referring to FIGS. 6–8, the elongate member 106 includes a pair of side portions 118 and 120 (see FIG. 6). The elongate member 106 further includes longitudinally extending openings 122 formed in each side 118 and 120. Member 104 includes a pair of side portions 124, 126 (see FIG. 6) and a plurality of passages 128 that extend substantially laterally with respect to the axis of the elongate member 104. Each passage 128 has openings accessible on both sides portions 118 and 120 of the elongate member 104. In one embodiment, each passage 128 has a substantially rectangular shape. However, each passage 128 can have a shape other than rectangular. The passages 128 are substantially aligned with and accessible through the longitudinally extending openings 122. Member 106 further includes a plurality of attachment loops 130 that are attached to side portions 118 and 120. In one embodiment, as shown in FIG. 7, elongate member 106 includes two (2) attachment members 130 on each side portion 118 and 120. However, it is to be understood that elongate member 106 may have less than or more than two (2) attachment members 130.

Figure 5:
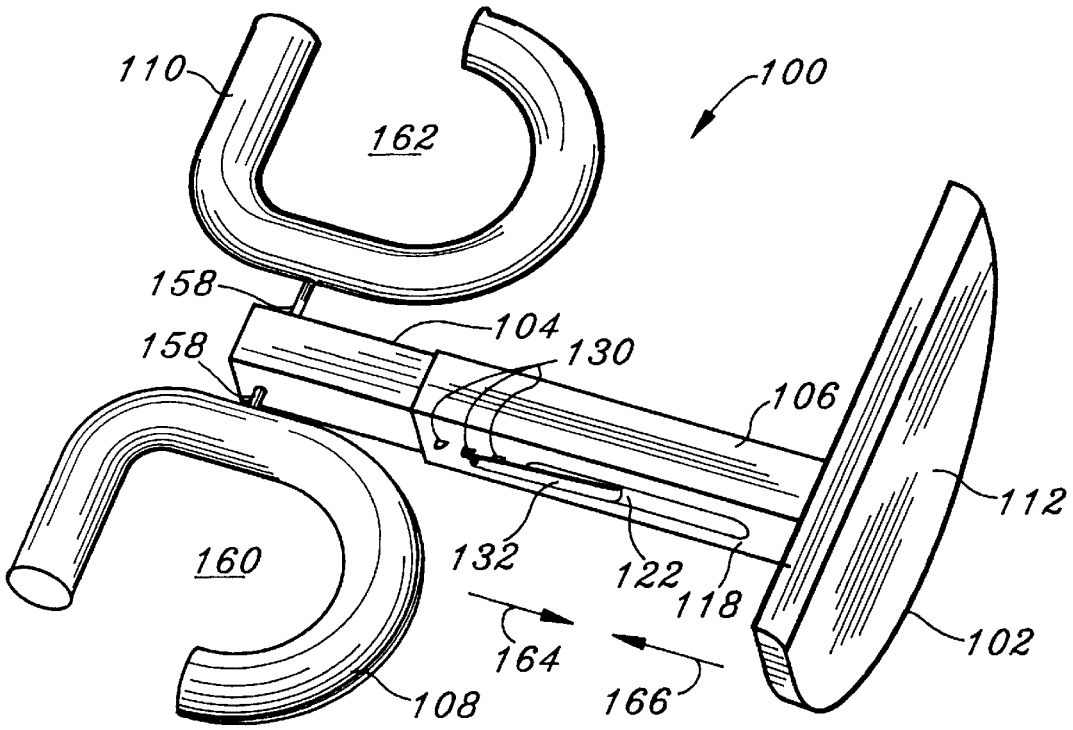
FIG. 5 is a perspective view of another embodiment of the apparatus of the present invention.
Figure 9:
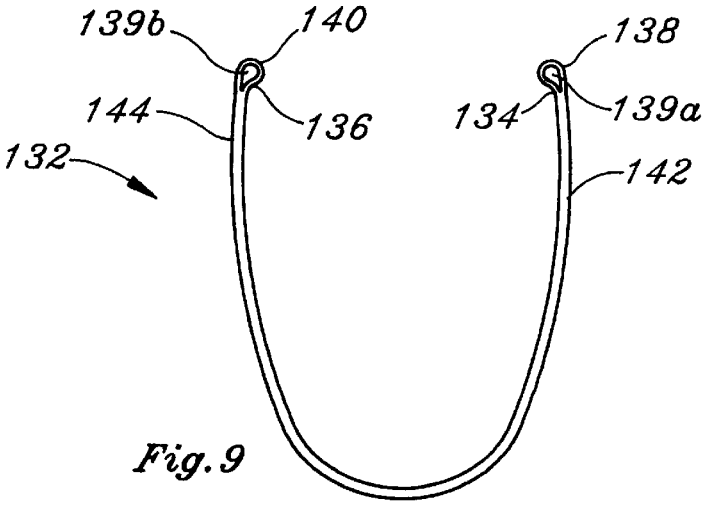
FIG. 9 is a top plan view of an elastic member depicted in FIG. 7.

Referring to FIGS. 5–7, apparatus 100 further includes elastic member 132. The elastic member 132 has a predetermined degree of elasticity. Elastic member 132 may be fabricated from any type of material that exhibits the appropriate degree of elasticity and can withstand significant tensile forces. Referring to FIG. 9, elastic member 132 includes end portions 134 and 136. Each portion 134 and 136 is folded over upon itself to form loops 138 and 140, respectively. Loops 138 and 140 define openings 139*a* and 139*b*, respectively. End portions 134 and 136 are attached to portions 142 and 144, respectively, of elastic member 132 by any one of the well known methods in the art, e.g. stitching, rivets, etc. Referring to FIG. 7, the elastic member 132 is inserted through one opening of a passage 128 and is pulled through the opposite opening of the passage 128 such that loop 138 is adjacent to side portion 118 and loop 140 is adjacent side portion 120.

Figure 10A:
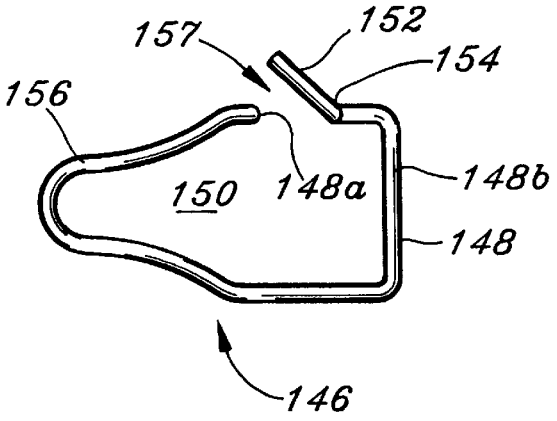
FIG. 10*a* is a side elevational view of a fastener member, depicted in FIG. 7, having a pivotal portion oriented to a first position.
Figure 10B:
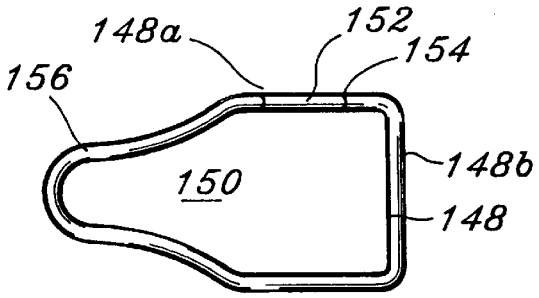
FIG. 10*b* is a side elevational view of a fastener member of FIG. 10*a* wherein the pivotal portion is oriented to a second position.

As shown in FIGS. 10*a* and 10*b*, apparatus 10 further includes a pair of fastener members 146, only one of which is shown. Each fastening member 146 has a body portion 148 that defines an opening 150. Body portion 148 further includes a portion 152 that is pivotally attached to the body portion 148 and pivots about pivot point 154. The body portion 148 includes a narrow portion 156, the purpose of which will be described below. Portion 152 is pivotal to a first position, as shown in FIG. 10*a*, and to a second position, as shown in FIG. 10*b*. When portion 152 is pivoted to the position shown in FIG. 10*a*, a space or gap 157 is created.

Figure 11:
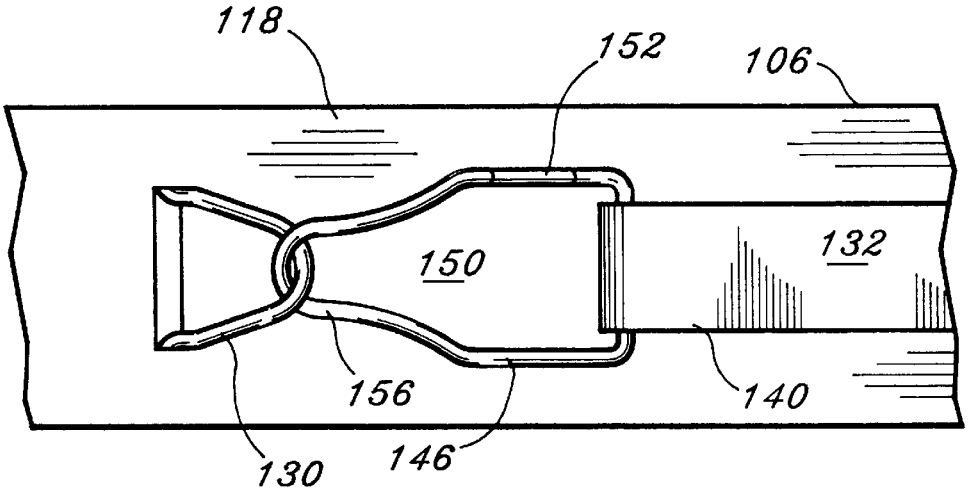
FIG. 11 is a side elevational view showing the fastener member of FIGS. 10*a* and 10*b* attached to and between the elastic and attachment members depicted in FIG. 7.

Referring to FIGS. 9, 10*a* and 10*b*, in order to attach fastener 146 to loops 138 and 140 of elastic member 132, the user positions the portion 152 of each fastener member 146 to the position shown in FIG. 10*a* in order to create a space or gap 157. Space or gap 157 allows the user to insert portion 148*a* of body portion 148 onto the openings 139*a* and 139*b* of loops 138 and 140, respectively. The user then adjusts each loop 138 and 140 so that it is positioned on portion 148*b* of each fastener member 146. The user then inserts portion 148*a* of body portion 148 through attachment member 130 and then pivots portion 152 to the position shown in FIG. 10*b*. FIG. 11 illustrates how the fastener member 146 is attached to the attachment member 130 and how the elastic member 132 is attached to fastener member 146. Although the description above is in terms of the fastener member 146 being configured as shown in FIGS. 10*a* and 10*b*, it is to be understood that almost any type of fastener member that can be removably attached to both the attachment members 130 and the elastic member 132 can also be used.

Referring to FIGS. 7 and 8, the user may adjust the overall tension on the elastic member 132 by inserting the elastic member 132 in different passages 128. For example, in order to decrease tension on the elastic member 132, the elastic member 132 is moved to a passage 128 that is farther away from the end 107 of the elongate member 104. In order to increase tension on the elastic member 132, the elastic member 132 is moved to a passage 128 that is closer to the end 107 of the elongate member 104.

Referring to FIG. 7, the tension on the elastic member 132 can also be adjusted by attaching the fastener members 146 to different attachment members 130. Specifically, the tension on the elastic member 132 increases as the fastener member 146 is attached to attachment members 130 that are closer to the 109 of the elongate member 106. The tension on the elastic member 132 decreases as the fastener members 146 are attached to the attachment members 130 that are farther away from the end 109 of the elongate member 106.

The ability to adjust the tension on elastic member 132 allows users of different heights, sizes and bodily strengths to comfortably use apparatus 100. The user may also replace one elastic member 132 having one predetermined elasticity with another elastic member having another elasticity. Although the description above is in terms of the apparatus 100 using only one elastic member 132 at a time, it is to be understood that a plurality of elastic members may be used simultaneously to increase the available tension.

Referring to FIGS. 5 and 6, elongate member 104 includes a bore therethrough that is sized for receiving axle or pin 158. Ankle supports 108 and 110 are attached to the axle 158. In a preferred embodiment, ankle supports 108 and 110 are rotatably attached to the axle 158. The ankle supports 108 and 110 have a body portion that defines openings 160 and 162, respectively, for receiving the feet and ankles of a user. The ankle supports 108 and 110 stabilize the feet and ankles to facilitate proper use of apparatus 100 of the present invention. This will be discussed in detail below. The ankle supports 108 and 110 are able to freely rotate or pivot to provide "self adjustment" as the user uses apparatus 100 and to facilitate storage of apparatus 100 when not in use. In a preferred embodiment, the ankle supports 108 and 110 are able to rotate 360°. The overall structure of each ankle support 108 and 110 is ergonomic so as to provide comfortable physical contact between the user's ankles and ankle supports 108 and 110. The rotational feature and ergonomic design of the ankle supports 108 and 110 substantially eliminate stress and/or strain on the user's ankles. In a preferred embodiment, the ankle supports 108 and 110 have a substantially circular cross-section. The ankle supports 108 and 110 may take on any one of a variety of geometric shapes, e.g. substantially C-shaped, substantially J-shaped, etc. In a preferred embodiment, ankle supports 108 and 110 are fabricated from durable, lightweight materials such as metal, plastic, rubber, fiberglass, graphite or other composite materials. In a preferred embodiment, axle or pin 158 are fabricated from durable materials that can withstand stress. Preferably, the axle or pin 158 is fabricated from metal, fiberglass, graphite or other composite materials.

In one embodiment, the pin or axle 158 is rigidly attached to elongate member 104 and ankle supports 108 and 110 are rotatably attached to axle 158. In another embodiment, the pin or axle 158 is slidably and rotatably disposed within the bore formed in the elongate member 104 and the ankle supports 108 and 110 are rigidly attached to the axle 158. In a further embodiment, the axle 158 is comprised of two separate axle portions wherein each axle portion is rigidly attached to the elongate member 104 and a corresponding ankle support is rotatably attached to the axle portion.

When a user attempts to do "sit-up" exercises, typically the user's knees do not remain stationary and either move up or down as the user is attempting to do a "sit-up". Thus, the user's ankles move either upward and/or away from the user's buttock. Many times, the user attempts to compensate for this by exerting muscular force to hold his or her feet down to the floor. Many times, the user will have a second person hold the user's feet stationary while the user does the sit-up exercises. However, apparatuses 10 and 100 of the present invention eliminates these problems. Referring to FIGS. 1 and 5, when the user desires to use apparatuses 10 or 100 of the present invention, the user places apparatus 10 or 100 on a flat surface, e.g. floor, and positions apparatus 10 or 100 such that (i) support member 12 or 102 is placed against the user's buttocks and (ii) the user's ankles are placed within openings 52, 54 or 160, 162 of ankle support members 18, 20 or 108, 110, respectively. In order to achieve optimum results, the user preferably maintains both feet in contact with the floor. The user may position his or her legs in a variety of ways in order to achieve optimum results. For example, it has been found that optimum results are achieved if the user positions his or her legs in a bend between about 60° and 120° with the femur and the tibia approximately 45° with respect to the floor. It also has been found that optimum results can be achieved if the user raises her or his legs such that the knees are bent about 90° and the femur is substantially perpendicular to the floor and the tibia is substantially parallel to the floor. Although the foregoing discussion describes specific angular positions of the user's legs, it is to be understood that the actual angular orientation of the user's legs may vary with each different user of apparatus 10 or 100.

When using apparatus 10 or 100 of the present invention, the user's ankles, knees and buttocks all remain substantially stationary. The natural tendency for the ankles to move away from the buttocks during an unassisted crunch or sit-up is counteracted by the internal spring 28 or elastic member 132. Ankle support members 18, 20 or 108, 110, substantially eliminate movement of the user's ankles and knees during use of apparatus 10 or 100, respectively. Referring to FIG. 1 and 5, any force of the user's ankles exerted in the direction indicated by arrow 164 is counteracted by a substantially equal force, indicated by arrow 166, created by the user's buttock against support member 12 or 102. These forces effect a resultant compressive force on the spring 28 and a tensile force on the elastic member 132. The aforementioned compressive and tensile forces are of such a degree as to allow the ankle support members 18, 20 or 108, 110 and the support members 12 or 112, respectively, to approach each other. It is highly preferable that the tension of the spring 28 is of a degree that prevents the support member 12 from contacting the elongate member 14. Similarly, it is highly preferable that the elasticity of the elastic member 132 is of a degree that prevents the support member 102 from contacting the elongate member 104.

Muscle strengthening apparatuses 10 and 100 of the present invention effects contraction of the hamstrings by squeezing the hamstrings, in effect, moving the ankles toward the buttocks simultaneously with contraction of the abdominal muscles. Apparatuses 10 and 100 of the present invention effect strengthening of the abdominal muscles while simultaneously inhibiting contraction of the psoas. Specifically, as muscle strengthening apparatuses 10 and 100 contracts the hamstrings, apparatuses 10 and 100 inhibits the psoas thereby providing maximum efficiency in strengthening the abdominal muscles. Support members 12 and 102 facilitate an optimum pelvic posterior tilt thereby maximizing the efficiency in strengthening and toning the abdominal muscles and obliques. Support members 12 and 102 allow the user to roll to the side to perform exercises for the obliques. Use of apparatus 10 and 100 also strengthens and tones the hamstring muscles and Gluteus Maximum.

Muscle strengthening apparatuses 10 and 100 of the present invention achieves proper rectus abdominal contraction and maximizes efficiency in strengthening the abdominal muscles and obliques. Apparatuses 10 and 100 effect neuro inhibition to substantially eliminate use of the hip flexors. As the user does a sit-up, apparatuses 10 and 100 causes contraction of the antagonistic muscles of the hip flexors which include the gluteus maximum and hamstrings. Apparatuses 10 and 100 effect contraction of these muscles to substantially eliminate activity of the hip flexors thereby achieving isolated rectus abdominis contraction.

Thus, the apparatuses 10 and 100 of the present invention:

a) stabilize the feet, knees and hips thereby maximizing the efficiency in toning and strengthening abdominal muscles and obliques;

b) effect toning and strengthening of other muscles, e.g. hamstrings and gluteus maximum, simultaneously with and in addition to the abdominal muscles;

c) facilitate correct pelvic tilt;

d) achieves significant increase in strength of abdominal muscles over a relatively short period of time;

e) prevent over development of the iliopsoas or hip flexors;

f) are lightweight and compact;

g) are inexpensive to manufacture;

h) are easy and convenient to use;

i) are transportable and easy to store; and j) provides a plurality of positions to which the feet securing member can be set thereby allowing users of different sizes or heights to use the apparatus of the present invention in a comfortable and efficient manner.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

What is claimed is:

1. A muscle strengthening apparatus comprising:

a first elongate hollow member having first and second end portions, the first elongate member having an engagement portion adjacent the first end portion;

a feet securing member for securing the feet of a user, the feet securing member being attached the second end portion of the first elongate member;

a second elongate hollow member slidably disposed within the first elongate member, the second elongate member having a first end portion disposed wherein the first elongate member and a second end portion, the axes of the first and second elongate members being substantially coaxial, the movement of the first and second elongate members being substantially linear, a system for exerting a force on the first and second elongate members so as to urge the first and second elongate members in opposite directions; and a support member for contacting the buttocks of the user, the support member being attached to the second end portion of the second elongate member, the second elongate member having an engagement portion adjacent the second end portion of the second elongate member for engaging the engagement portion of the first elongate member so as to prevent the second elongate member from being dislodged from the first elongate member.

2. The muscle strengthening apparatus according to claim 1 wherein the first and second elongate members have substantially square cross-sections.

3. The muscle strengthening apparatus according to claim 1 wherein the engagement portion of the first elongate member comprises an inwardly flanged portion and the engagement portion of the second elongate portion comprises an outwardly flanged portion.

4. The muscle strengthening apparatus according to claim 1 wherein the system comprises a spring disposed within the first and second elongate members.

5. The muscle strengthening apparatus according to claim 1 wherein the second elongate member is hollow and the first elongate member is slidably disposed within the second elongate member, the first and second members having a pair of side portions, each side portion of the second elongate member having a longitudinally extending opening, the portion of the first elongate member that is disposed within the second elongate member having at least one passage extending laterally with respect to the axis of the first elongate member, the passage having openings that are aligned with and accessible through the longitudinal opening formed in the side portions of the second elongate member.

6. The muscle strengthening apparatus according to claim 5 wherein the system comprises an elastic member having a portion disposed within the laterally extending passage of the first elongate member and extending through the longitudinally extending openings formed in the side portions of the second elongate member, the elastic member having a first end attached to one of the side portions of the second elongate member and a second end attached to the other side portion of the second elongate member.

7. The muscle strengthening apparatus according to claim 6 wherein the elastic member is removably attached to the side portions of the second elongate member.

8. The muscle strengthening apparatus according to claim 6 wherein the system further comprises a pair of fastener members, each fastener member being attached to a corresponding end of the elastic member and to a corresponding side portion of the second elongate member.

9. The muscle strengthening apparatus according to claim 8 wherein the system further comprises at least one pair of attachment members, each attachment member being attached to a corresponding side portion of the second elongate member, each fastener member being attached to a corresponding attachment member.

10. The muscle strengthening apparatus according to claim 1 wherein the feet securing member is pivotally attached to the first elongate member.

11. The muscle strengthening apparatus according to claim 1 wherein the feet securing member comprises a pair of foot retaining members, each of which having a body portion defining an opening sized for receiving a foot of a user; and an axle attached to the first elongate member, the axle being intermediate and attached to the foot retaining members.

12. The muscle strengthening apparatus according to claim 11 wherein the axle is rotatably attached to the first elongate member.

13. The muscle strengthening apparatus according to claim 11 wherein each body portion of the feet retaining members has a substantially circular cross-sectional shape.

14. The muscle strengthening apparatus according to claim 11 wherein each body portion has a substantially "C" shape.

15. The muscle strengthening apparatus according to claim 11 wherein each body portion is covered with a relatively soft and flexible material to provide comfortable contact with the user's ankles or feet.

16. The muscle strengthening apparatus according to claim 1 where the support member is pivotally attached to the second elongate member.

17. The muscle strengthening apparatus according to claim 1 wherein the support member has a substantially planar surface for contacting the buttocks of the user.

* * * * *